United States Patent [19]

Martin et al.

[11] 3,973,681

[45] Aug. 10, 1976

[54] TRANSITION CASTING FOR USE IN SILLS OF FREIGHT CARS

[75] Inventors: Albert Edward Martin, Lancaster, N.Y.; Stanley Herbert Fillion, Wilmette, Ill.

[73] Assignee: Dresser Industries, Inc., Dallas, Tex.

[22] Filed: Feb. 27, 1975

[21] Appl. No.: 553,938

[52] U.S. Cl. ..... 213/8; 105/420; 213/57

[51] Int. Cl.[2] ..... B61G 9/22

[58] Field of Search ..... 213/8, 57, 51; 105/420, 105/416, 418

[56] References Cited

UNITED STATES PATENTS

| | | | |
|---|---|---|---|
| 976,426 | 11/1910 | Becker | 105/416 |
| 3,223,050 | 12/1965 | Warnock | 213/57 X |
| 3,561,370 | 2/1971 | Reynolds | 105/420 |
| 3,677,198 | 7/1972 | Yang et al. | 105/420 |

*Primary Examiner*—Robert B. Reeves
*Assistant Examiner*—John P. Shannon
*Attorney, Agent, or Firm*—R. T. Majesko; J. N. Hazelwood

[57] ABSTRACT

The invention relates to railway cars having a tubular-like sill in the underframe and a standard Z type draft sill at each end and a transition sill telescoping into and connecting the draft sill to the tubular sill.

6 Claims, 3 Drawing Figures

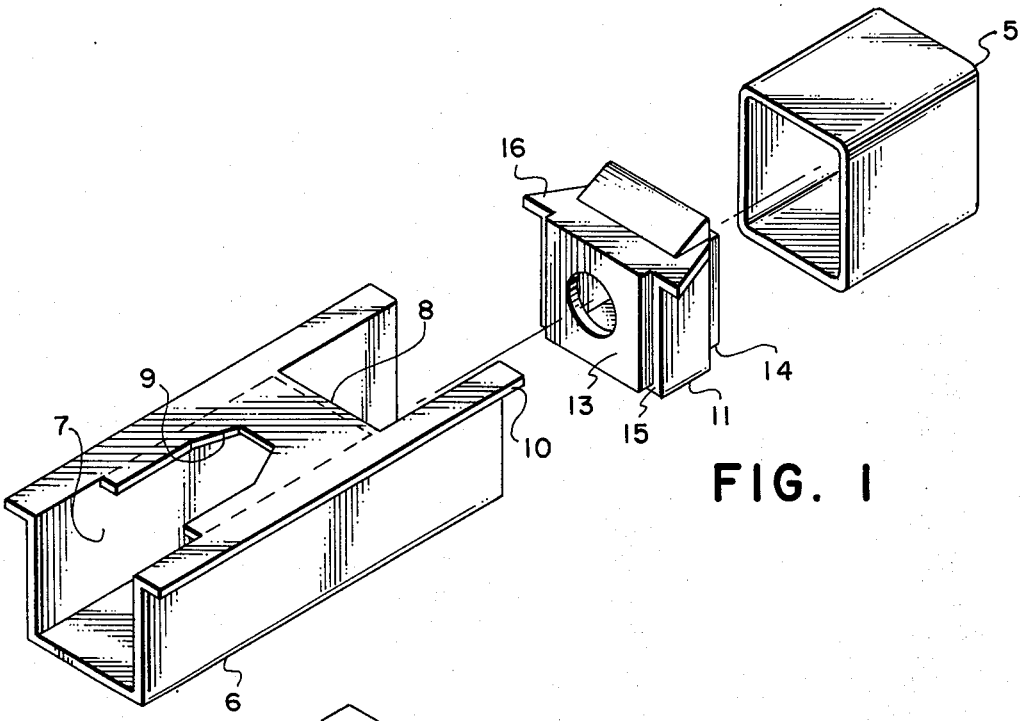
FIG. 1
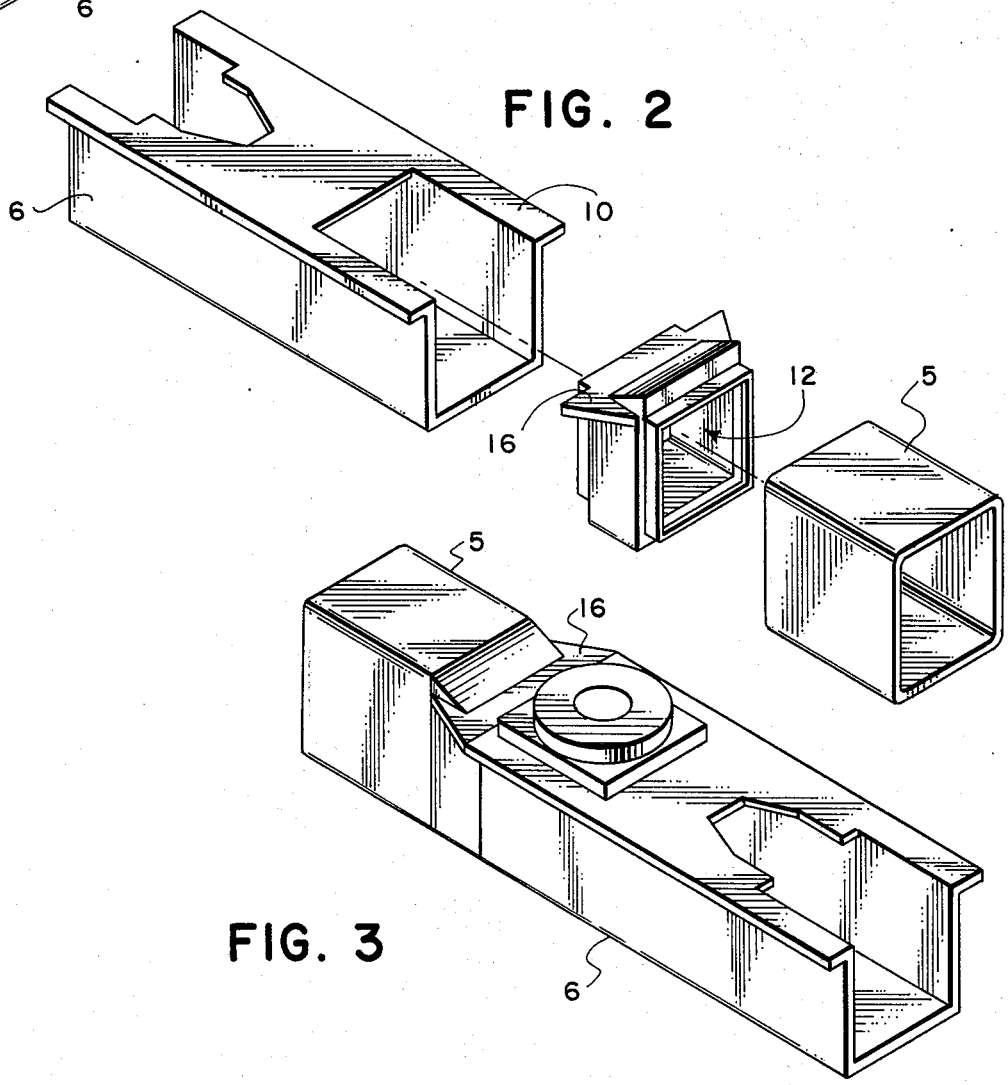
FIG. 2
FIG. 3

TRANSITION CASTING FOR USE IN SILLS OF FREIGHT CARS

In the past, conventional freight car construction has used a continuous sill construction having an inverted U shape section with laterally outwardly extending lower flanges commonly called the AAR standard Z sill section. Particularly on hopper cars, it would be beneficial to use a tubular or Weirton type sill to increase the size of hopper door openings and increase cubic content. However such a sill presents a difficult problem in the draft pocket area because the bottom wall must be removed and laterally outwardly extending flanges added to provide for application of draft rigging. Since the tubular sills provide distinct car construction advantages and are said to have superior compressive strength and resistance to impact without buckling, a desire has been expressed by the railroads to use the tubular sill only between the bolsters and maintain the AAR standard sills at the ends.

Accordingly, it is an object of the present invention to provide a transition sill for connecting a tubular-like sill to a standard AAR Z section draft sill without deleteriously affecting strength and shock requirements. Another object is to provide a transition member that incorporates a portion of the center filler structure.

IN THE DRAWINGS

FIG. 1 is a perspective view of an inverted disassembled construction according to the invention from a front angle;

FIG. 2 is a perspective view of a disassembled construction of the invention from a rear angle; and, FIG. 3 is a perspective view of an assembled construction according to the invention from a side angle also showing a low profile type center filler in place.

In accordance with the present invention, there is provided a sill construction for use in an underframe of a railway car. The construction contains one or more centrally located inverted U-shaped or AAR (American Association of Railroads) Z section draft sills, having a standard pocket for receiving a draft rigging including a center filler disposed longitudinally at one or more ends thereof. A fixed, elongated, longitudinally extending tubular-like sill is connected to the draft sill by a transition sill which telescopingly engages and mates with surfaces of the tubularlike sill and the draft sill.

Referring to the drawings, there is shown viewing from the bottom a portion of a tubular sill 5 which would be the main member of a welded or otherwise assembled underframe of a railway car. The sill extends centrally between the body bolsters which carry the center plate or bearings that interface with the trucks that pivotally support the car body. The sill is shown as being rectangular in cross-section with all walls being connected. As an alternate, a Weirton-type sill may be employed. This type sill is rectangular in cross-section with the bottom wall being disconnected so as to provide a longitudinal slot along the length thereof. Stated differently, in cross-section the sill appears as an inverted U-shaped sill with lower lateral flanges extending inwardly. Thus, the term tubular-like is intended to cover both types of sills or any equivalent sills.

A draft sill 6 is attached at each end of the underframe and extends from the bolster to the end of the underframe. The draft sill has an opening 7 therein at one end for accommodating the draft gear, striker, yoke and coupler shank (not shown). At the other end, the U-shaped or AAR Z section draft sill has a vertical wall 8 and tie plates 9 which form a portion of the center filler or center filler pocket. As shown in the drawing, the draft sill contains an outer laterally extending flange 10 at the lower end of each side and is usually formed from the AAR standard Z section.

The transition member 11 which is generally formed by casting is rectangular in cross-section and has a large opening 12 at the tube sill end and a vertical wall 13 with a smaller opening at the draft sill end. The tube sill end contains a peripheral recessed portion 14 that enables it to telescopingly engage the tubular sill which may have a larger cross-section than does the draft sill.

The draft sill end contains another peripheral recess 15 around the three sides thereof that mates with corresponding surfaces of the U-shaped sill. The transition sill contains a laterally extending wing 16 which mates with the extending flange of the draft sill and tapers inwardly toward the tubular sill. The transition member at the draft sill end has a vertical wall 13 which when telescoped into the U-shaped sill along the peripheral recess forms a transverse shear member of the center filler structure.

As can be seen in FIG. 3, the transition sill is constructed such that when telescoping and mating with the tubular sill and the draft sill, all mating surfaces of the transition sill are flush with substantially all mating surfaces of the draft sill and tubular sill. This construction provides for the relatively smooth flow of stresses from end to end of the railway car.

In FIG. 3, a center filler is also shown fixed in place. The filler which has vertically extending lips (not shown) is merely seated in the pocket formed by the transition member walls 13 and the fabricated wall 8 of the draft sill, and welded therein securely While the tubular sill has been illustrated as rectangular in cross-section, other configurations, such as circular, may also be employed so long as the tubular sill end of the transition sill is adapted to conform to that configuration for telescoping therein.

Having thus described the invention in detail and with sufficient particularity as to enable those skilled in the art to practice it, what is desired to have protected by Letters Patent is set forth in the following claims.

The embodiments of the invention in which an exclusive property or privilege is claimed are defined as follows:

1. In a railway car having an underframe, the combination of at least one centrally located inverted U-shaped draft sill, disposed longitudinally at an end thereof; a fixed, elongated longitudinally extending tubular-like sill connected to the draft sill by a transition member which telescopes into and mates with surfaces of the tubular-like sill and the draft sill, the U-shaped sill having a pocket for receiving a center filler, the transition member having a vertical end wall which provides one side of the center filler pocket.

2. The combination of claim 1 in which the draft sill contains a laterally extending flange at the lower end of each side thereof.

3. The combination of claim 1 in which the transition member has a laterally extending wing at the lower end of each side thereof which mates with the flange of the draft sill and tapers inwardly rearwardly spanning the full distance from the fixed sill to the draft sill.

4. The combination of claim 1 in which the fixed tubular-like sill is rectangular in cross-section as viewed down the longitude thereof.

5. The combination of claim 1 in which the tubular-like sill is larger in cross-sectional area than the draft sill.

6. The combination of claim 1 in which all mating surfaces of the transition member are flush with substantially all mating surfaces of the draft sill and tubular-like sill.

* * * * *